US006684723B1

(12) United States Patent
Stöckle

(10) Patent No.: US 6,684,723 B1
(45) Date of Patent: Feb. 3, 2004

(54) DEVICE FOR PRODUCING A LIFTING AND LOWERING MOVEMENT

(75) Inventor: Stefan Stöckle, Freiburg (DE)

(73) Assignee: Hatebur Umformmaschinen AG, Reinach (CH)

( * ) Notice: Subject to any disclaimer, the term of this patent is extended or adjusted under 35 U.S.C. 154(b) by 91 days.

(21) Appl. No.: 10/030,629

(22) PCT Filed: Jun. 30, 2000

(86) PCT No.: PCT/CH00/00353

§ 371 (c)(1),
(2), (4) Date: Jan. 11, 2002

(87) PCT Pub. No.: WO01/08832

PCT Pub. Date: Feb. 8, 2001

(30) Foreign Application Priority Data

Jul. 29, 1999 (CH) ..... 1410/99

(51) Int. Cl.[7] ..... F16H 25/08
(52) U.S. Cl. ..... 74/54; 74/25; 74/567
(58) Field of Search ..... 24/25, 54, 567

(56) References Cited

U.S. PATENT DOCUMENTS 3,603,164 A * 9/1971 Ban ..... 74/54
4,527,446 A * 7/1985 Borodin ..... 74/828
5,029,836 A * 7/1991 Swaneck ..... 74/54
5,211,066 A * 5/1993 Koga et al. ..... 74/567
5,411,588 A * 5/1995 Diepens et al. ..... 74/25
5,541,378 A * 7/1996 Niklaus ..... 74/567
5,718,152 A 2/1998 Thudium et al.

FOREIGN PATENT DOCUMENTS

| | | | |
|---|---|---|---|
| GB | 730321 | 5/1955 | |
| GB | 1237182 | 10/1970 | |
| JP | 55040346 A * | 3/1980 | ..... F16H/37/12 |
| WO | WO 98/14289 | 4/1998 | |

* cited by examiner

*Primary Examiner*—David A. Bucci
*Assistant Examiner*—Timothy McAnulty
(74) *Attorney, Agent, or Firm*—Leydig, Voit & Mayer, Ltd.

(57) ABSTRACT

An apparatus for producing a lifting and lowering movement for lifting and lowering transverse transporting tongs of a forming machine includes a rotatable control shaft on which a control cam, a counter cam and a spring element cam are fitted. A pivotably mounted double lever has a control roller arm, a counter roller arm and a drive output arm. A control roller, rolling on the control cam, is rotatably arranged on the control roller arm and a counter roller, rolling on the counter cam, is rotatably arranged on the counter roller arm. The control cam and the counter cam act on the double lever in opposite directions of rotation. On the spring element cam there rolls a spring element roller arranged on a spring element lever. Arranged on the spring element lever is a spring element, which acts on the double lever in the same direction of rotation as the counter roller.

11 Claims, 5 Drawing Sheets

DEVICE FOR PRODUCING A LIFTING AND LOWERING MOVEMENT

FIELD OF THE INVENTION

The present invention relates to an apparatus for producing a lifting and lowering movement for lifting and lowering transverse transporting tongs of a forming machine. The apparatus according to the invention can be used both in hot-forming machines and in cold-forming machines.

BACKGROUND

In forming machines, the workpieces are often transported transversely by means of transverse transporting tongs from one forming station to the next and the empty transverse transporting tongs are then transferred back again into the starting position. From WO 98/14289 it is known, for example, to couple the transverse transporting tongs to a transverse transporting tube by means of a tong case and to displace the tong case, with the transverse transporting tongs holding the workpieces, from the starting position into the release position by means of displacing the transverse transporting tube in the longitudinal direction of the tube. As this happens, the tong case, provided with a roller, rolls on a rule fitted on the anvil. For guiding the empty transverse transporting tongs back after releasing the workpieces, the tong case with the transverse transporting tongs is lifted by turning the transverse transporting tube and is transferred back into the starting position by displacing the transverse transporting tube back in the longitudinal direction of the tube and lowering the tong case again. The raising of the transverse transporting tongs during the return transfer serves the purpose of avoiding the forming tools.

The lifting and lowering of the transverse transporting tongs takes place by the pivoting of a double lever, having a control roller arm and a counter roller arm, by means of a control cam and a counter cam, which are fitted on a rotatable control shaft and act on the double lever in opposite directions of rotation. For this purpose, a control roller, rolling on the control cam, is rotatably arranged on the control roller arm and a counter roller, rolling on the counter cam, is rotatably arranged on the counter roller arm.

The fact that the transverse transporting tongs are not lifted during the displacement from the starting position into the release position and the tong case rolls on the rule has the disadvantage that, if the rule or the tong case roller is soiled, an irregular movement takes place and the tong case is possibly inaccurately placed in the release position and/or starting position. Furthermore, when the tong case is set down on the rule there may be vibrations or stresses, possibly causing deformations, due to an overdetermination on account of inaccuracies or soiling of the control cam, the counter cam, the double lever, the tong case etc. A further disadvantage is that the tong case is set down relatively hard when it is returned into the starting position.

In the case of the forming machines described in GB-B-730 321, the transverse transporting tongs are lifted and lowered again both during the transfer from the starting position into the release position and during the transfer from the release position into the starting position, in order to permit a turning of the transverse transporting tongs during the transverse displacement. The lifting and lowering takes place by pivoting a double lever, having a control roller arm and a counter roller arm, by means of a control cam and a counter cam, which act on the double lever in opposite directions of rotation. The control cam and the counter cam do not rotate here, but move back and forth. A control roller, rolling on the control cam, is rotatably arranged on the control roller arm and a counter roller, rolling on the counter cam, is rotatably arranged on the counter roller arm. A fixedly mounted spring presses the control roller arm with the control roller permanently against the control cam.

Although the lifting of the transverse transporting tongs both during the transfer from the starting position into the release position and during the transfer from the release position into the starting position does avoid the problems possibly occurring if the tong case rolls on the anvil or the rule, the further disadvantages mentioned above with respect to the transverse transporting and lifting apparatus known from WO 98/14289 still remain.

SUMMARY OF THE INVENTION

In view of the disadvantages of the previously known transverse transporting and lifting apparatuses described above, the invention is based on the following object. An apparatus for producing a lifting Land lowering movement for the lifting and lowering of transverse transporting tongs of the type mentioned at the beginning, with which the transverse transporting tongs can be lifted and lowered again in the desired way, is to be provided, it being intended in particular that a gentle lowering into the fully lowered position is possible and that an overdetermination over wide ranges as well as vibrations can be avoided.

The apparatus according to the invention for producing a lifting and lowering movement for lifting and lowering transverse transporting tongs of a forming machine is essentially constructed as follows: a control cam and a counter cam are fitted on a movable cam carrier. A pivotably mounted double lever has a control roller arm and a counter roller arm, with a control roller, rolling on the control cam, being rotatably arranged on the control roller arm and a counter roller, rolling on the counter cam, being rotatably arranged on the counter roller arm, and the control cam and the counter cam acting on the double lever in opposite directions of rotation. The apparatus also comprises a movable spring element cam, on which there rolls a spring element roller arranged on a spring element lever, and a spring element, which is arranged on the spring element lever and acts on the double lever in the same direction of rotation as the counter roller.

The fact that, in addition to the control cam, the counter cam and the double lever, a spring element cam and a spring element lever with a spring element are present means that the lifting and lowering movement can be controlled alternately by the control cam and the counter cam on the one hand and by the control cam and the spring element cam on the other hand. Control by the control cam and the spring element cam is appropriate in particular in the region of the fully lowered position of the transverse transporting tongs, in order on the one hand to ensure a setting down with virtually no velocity, i.e. gentle setting down, of for example a tong case carrying the transverse transporting tongs on the anvil or a plate and on the other hand to prestress the transverse transporting tongs downward, so that neither vibrations nor overdetermination takes place, as would be the case if the control cam and the counter cam were to act on the double lever at the same time as the anvil or the plate act on the tong case. Controlling by the control cam and the counter cam is appropriate on the other hand in the middle and higher lifting regions for the safe and precise guidance of the relatively heavy tong case with the transverse transporting tongs.

The spring element cam is advantageously fitted on the movable cam carrier and the double lever and the spring element lever are advantageously fitted rotatably on a common spindle. The apparatus can in this way be of a relatively simple construction and the spring element does not have to make way any more than necessary.

In a preferred design variant, the spring element cam and the counter cam have the same curved shape and are formed as a single cam. This makes the apparatus even more simple and inexpensive to produce.

In another preferred design variant, the spring element cam is formed separately from the counter cam. This makes it possible for the spring force to be varied suitably by corresponding shaping of the spring element cam.

The control cam, the counter cam and the spring element cam are preferably shaped in such a way that, in the fully lowered position of the transverse transporting tongs, the spring element roller bears against the spring element cam and the spring element exerts on the double lever a torque pressing the transverse transporting tongs downward, while the control roller is lifted off the control cam and the counter roller is lifted off the counter cam. As a result, in the fully lowered position only the spring element cam and the anvil are acting, via the resting tong case, in a way which provides prestressing and entirely eliminates any overdetermination.

BRIEF DESCRIPTION OF DRAWING FIGURES

The apparatus according to the invention for producing a lifting and lowering movement for lifting and lowering transverse transporting tongs of a forming machine is described in more detail below on the basis of an exemplary embodiment with reference to the attached drawings, in which.

DETAILED DESCRIPTION

FIG. 1

Figure 1:
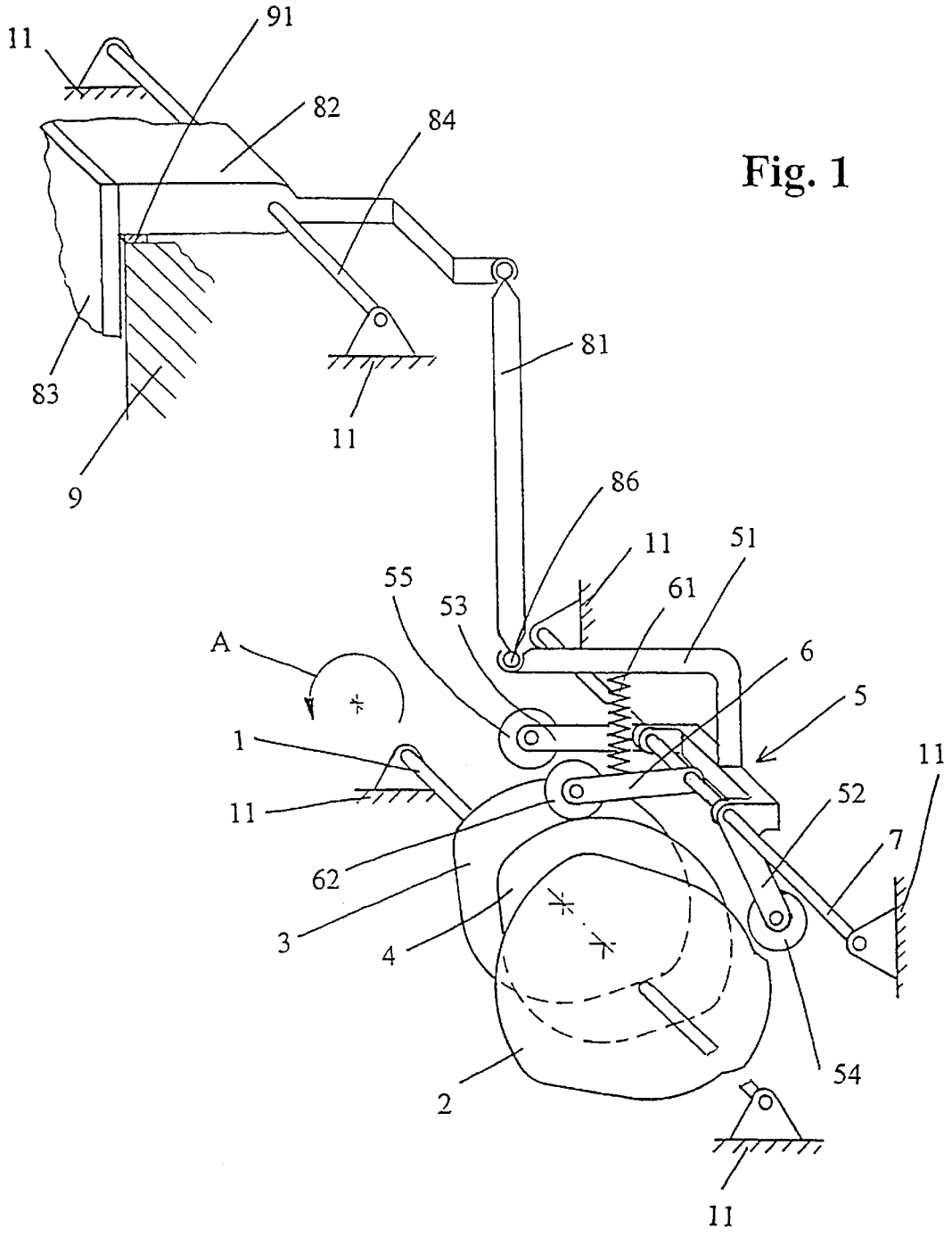
FIG. 1 shows a schematic representation of an apparatus according to the invention with a tong case in the fully lowered position.

In the exemplary embodiment represented, a control cam 2, a counter cam 3 and a spring element cam 4 are fitted in a rotationally fixed manner on a movable cam carrier in the form of a control shaft 1. The control shaft 1 is mounted rotatably in the direction of the arrow A on the machine body 11 and is driven by a motor (not drawn). Likewise fastened on the machine body 11 is a spindle 7, which is parallel to the control shaft 1 and on which a double lever 5 and a spring element lever 6 are rotatably articulated. The double lever 5 comprises a control roller arm 52, a counter roller arm 53 and a drive output arm 51. Rotatably mounted at the free end of the control roller arm 52 is a control roller 54, which rolls on the control cam 2, while a counter roller 55, which rolls on the counter cam 3, is rotatably mounted at the free end of the counter roller arm 53. For the purposes of the present description and patent claims, rolling is not understood as meaning that the corresponding roller is continuously in contact with the associated cam and continuously rolls on it, but that it bears against the cam at least some of the time and rolls on it at this time.

The control roller arm 52 and the counter roller arm 53 are arranged in such a way that the control roller 54 and the counter roller 55 are located on different sides of the plane passing through the control shaft 1 and the spindle 7. This has the consequence that the control cam 2 and the counter cam 3 act on the double lever 5 in opposite directions of rotation.

The spring element lever 6 has at its free end a rotatably mounted spring element roller 62, which rolls on the spring element cam 4. Arranged between the spring element lever 6 and the drive output arm 51 of the double lever 5 is a spring element 61, which is drawn here as a spring. In practice, a bellows cylinder is preferably used, but in principle any other spring elements which, depending on the design of the double lever 5, can also act on the counter roller arm 53 or, for example as tension springs, on the control roller arm 52 are conceivable. The spring element cam 4 and the spring element 61 act on the double lever 5 in the same direction of rotation as the counter cam 3.

The free end of the drive output arm 51 is connected here via a ball joint 86 to the one end of a coupling rod 81, the other end of which is jointedly connected to a tong case 82, on which there are fitted tong cartridges 83 with transverse transporting tongs (not represented). The tong case 82 is fixedly attached to a transverse transporting tube 84, which can be displaced rotationally and longitudinally on the machine body 11. By displacing the transverse transporting tube 84 in its longitudinal direction, the tong case 82, and consequently the tong cartridges 83, can be transversely displaced with the transverse transporting tongs, the transverse displacement being coordinated with a lifting and lowering movement controlled by the control cam 2, counter cam 3 and spring element cam 4.

In the fully lowered position represented of the transverse transporting tongs, the tong case 82 is supported on a plate 91 of an anvil 9. The spring element roller 62 is bearing against the spring element cam 4, while the control roller 54 and the counter roller 55 are lifted off the control cam 2 and counter cam 3, respectively. The spring element 61 presses the drive output arm 51 of the double lever 5 upward, so that the coupling rod 81 and the end of the tong case 82 connected to it are likewise pressed upward, and consequently the side of the tong case 82 bearing the tong cartridges 83 is pressed downward. The tong case 82 therefore rests on the plate 91 under a certain prestress. Since only the spring element cam 4, but neither the control cam 2 nor the counter cam 3, is effective, stresses possibly producing deformations between the anvil 9 and the control cam 2 or the counter cam 3 on account of overdetermination are eliminated. As far as the spring element cam 4 is concerned, it acts only in a sprung manner, via the spring element 61, so that there is no overdetermination in this respect either.

The following statement applies to the entire further description. If reference numerals are contained in a figure for the purpose of graphic clarification, but are not explained in the directly associated text of the description, reference is made to where they are mentioned in descriptions of previous figures.

FIG. 2

If, starting from the position represented in FIG. 1, the control shaft 1 is turned in the direction of the arrow A, the control roller arm 52 is pressed outward by a bulge 21 of the control cam 2, via the control roller 54, which has the consequence that the double lever 5 is turned in the same direction of rotation as the control shaft 1. As a result, the coupling rod 81 and the end of the tong case 82 connected to it are pulled downward and the end of the tong case 82 carrying the tong cartridges 83 with the transverse transporting tongs is lifted into a low lifting position. The counter cam 3 is still not effective, while the spring element 61 has been compressed and is consequently exerting a greater torque on the drive output arm 51 of the double lever 5.

If the control shaft 1 is turned further, the control roller 54 goes into a depression 22, where it no longer bears against the control cam 2. The double lever 5 is in this case pivoted back in the direction of rotation opposite to the control shaft 1, until the fully lowered position of the transverse transporting tongs is reached again, in which the only one of the cams which is effective is the spring element cam 4, via the spring element 61. The setting down of the tongs case 82 on the plate 91 takes place with virtually no velocity.

During the lifting of the transverse transporting tongs into the low lifting position and the subsequent lowering again into the fully lowered position, the transverse transporting tube 84, and consequently the tong case 82 and the tong cartridges 83 with the transverse transporting tongs, are displaced in the direction of the arrow B. In this way, workpieces can be transported by means of the transverse transporting tongs from one forming station to the next.

FIG. 3

If, after the depression 22 has reached the control roller 54, the control shaft 1 is turned further in the direction of the arrow A, the control roller arm 52 is pressed outward by a bulge 23 of the control cam 2, via the control roller 54, which has the consequence that the double lever 5 is turned in the same direction of rotation as the control shaft 1. Since, in comparison with the bulge 21, the bulge 23 is much larger, the double lever 5 is pivoted much more and the transverse transporting tongs are lifted into a high lifting position. From a certain point in time during the lifting, the counter roller 55 comes to lie against the counter cam 3 and the double lever 5, and consequently finally the transverse transporting tongs, are jointly guided safely and precisely by the control cam 2 and the counter cam 3.

If the control shaft 1 is turned still further, the bulge 23 is turned away under the control roller 54 and, finally, the position represented in FIG. 1 is reached again. The double lever 5 is in this case turned back in the direction of rotation opposite to the control shaft 1 until the fully lowered position of the transverse transporting tongs is reached again, in which the only one of the cams which is effective is the spring element cam 4, via the spring element 61, since the counter roller 55 is lifted off the counter cam 3 at a certain point in time during, and the control roller 54 is lifted off the control cam 2 shortly before, the completion of the lowering. Here, too, the setting down of the tong case 82 on the plate 91 takes place with virtually no velocity.

During the lifting of the transverse transporting tongs into the high lifting position and the subsequent lowering again into the fully lowered position, the transverse transporting tube 84, and consequently the tong case 82 and the tong cartridges 83 with the empty transverse transporting tongs, are displaced back in the direction of the arrow C. The transverse transporting tongs consequently arrive back in the starting position, where they can grasp new workpieces.

FIG. 4

Figure 2:
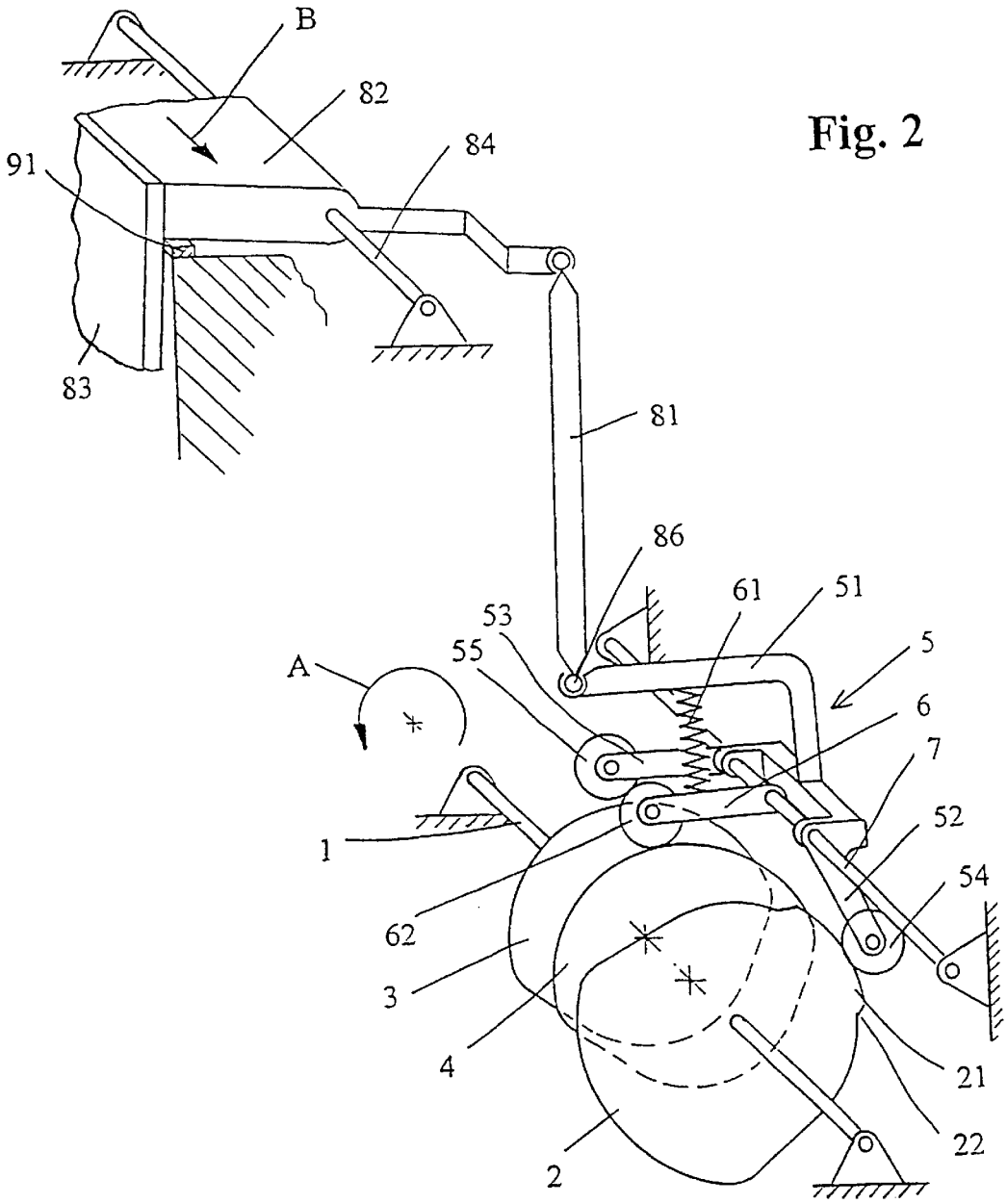
FIG. 2 shows the apparatus from FIG. 1 with the tong case in a low lifting position.
Figure 3:
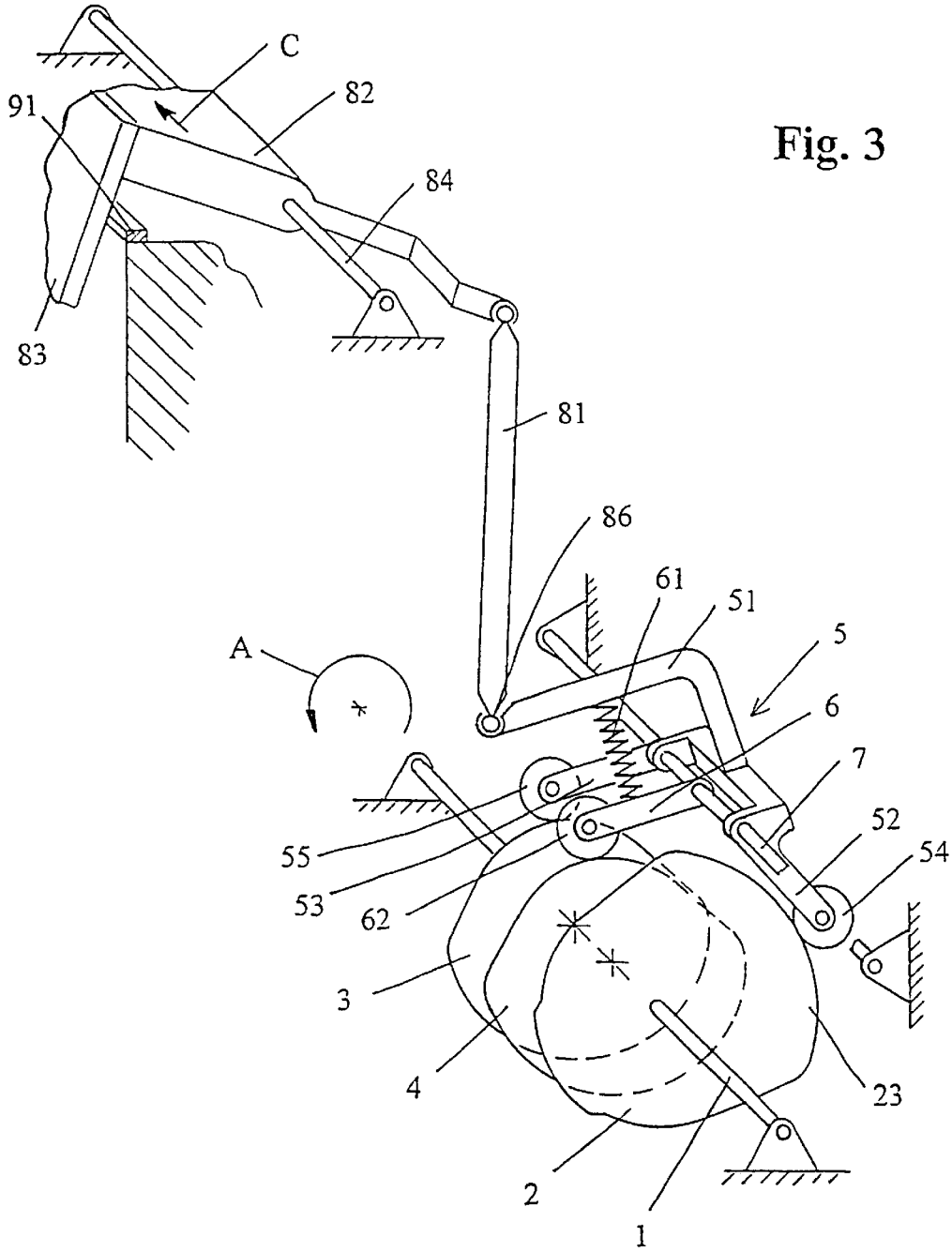
FIG. 3 shows the apparatus from FIG. 1 with the tong case in a high lifting position.

The movement of the tong case 82 explained in conjunction with FIGS. 1 to 3 is graphically represented here, the movement taking place in the direction of the drawn arrows. At the point P, the tong case 82 is located in the fully lowered position according to FIG. 1. Subsequently, with simultaneous transverse displacement from the point P to the point Q, it is lifted into the low lifting position according to FIG. 2 and is lowered again into the fully lowered position. The distance of the tong case 82 from the plate 91 in the low lifting position is relatively small, for example 1–3 mm, since it just has to be ensured that the tong case 82 is not resting on the plate 91. During the movement from the point P to the point Q, workpieces are transported by the transverse transporting tongs from one forming station to the next and are released there by the transverse transporting tongs.

Subsequently, the tong case 82 with the transverse transporting tongs is lifted into the high lifting position according to FIG. 3 and lowered again into the fully lowered position while simultaneously being displaced back from the point Q to the point P. The distance from the tong case 82 to the plate 91 in the high lifting position is relatively great, for example approximately 50% of the length of the horizontal displacement, since it has to be ensured that the transverse transporting tongs do not touch the forming tools.

FIG. 5

Figure 4:
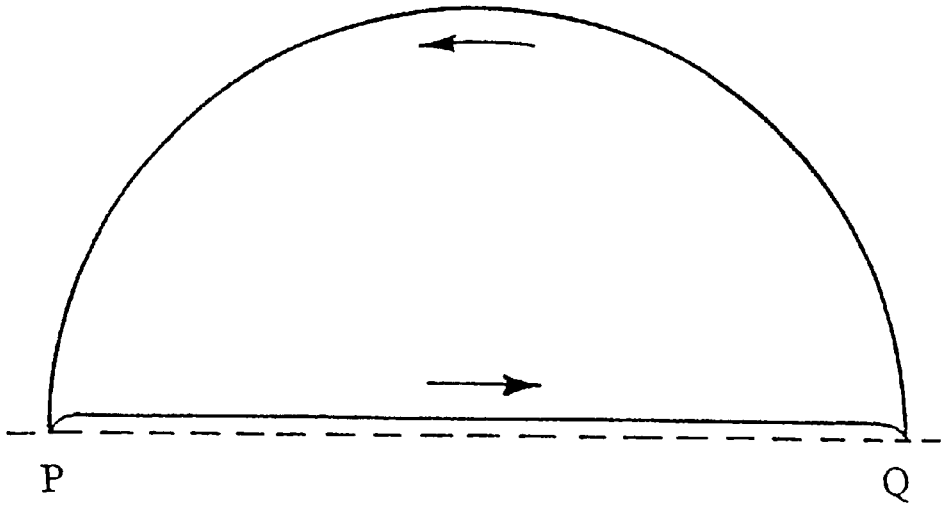
FIG. 4 shows a first possible path of the tong case in the forming machine.
Figure 5:
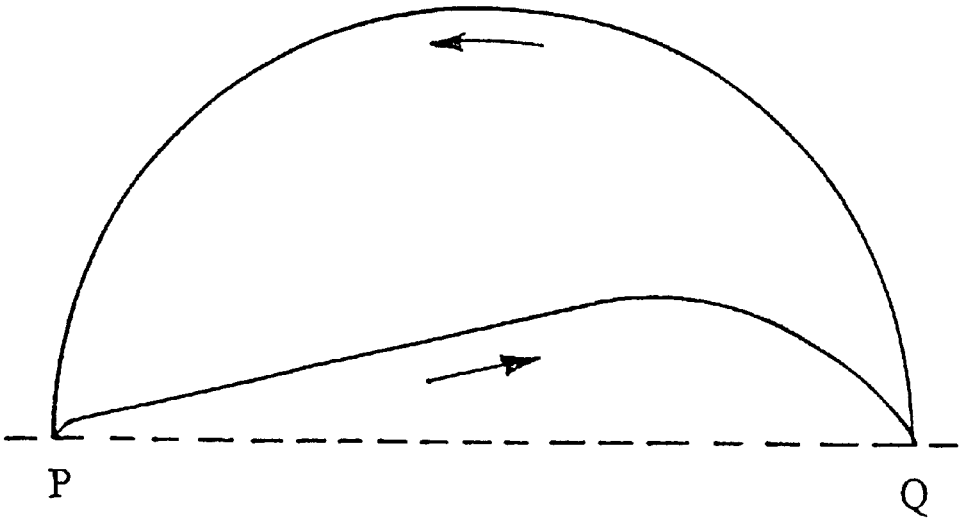
FIG. 5 shows a second possible path of the tong case in the forming machine.

Alternatively, it may be advisable not to perform the transport of the workpieces in the low lifting position represented in FIGS. 2 and 4, since, for example, there is in the last forming station a chute for carrying away the formed workpieces and said chute cannot be optimally placed when there is a virtually horizontal transverse displacement of the transverse transporting tongs. It is to be preferred for the tong case 82 with the transverse transporting tongs to be brought to the point Q from above. In the case of the advantageous path of movement represented here, the tong case 82 therefore moves in the direction of the arrow from the fully lowered position at point P in a slowly rising manner into a middle lifting position and is then lowered relatively quickly, preferably approximately three times as quickly as the lifting movement, into the fully lowered position at point Q. The distance from the tong case 82 to the plate 91 in the middle lifting position is preferably approximately one-third of the distance from the tong case 82 to the plate 91 in the high lifting position.

As in the case of the variant represented in FIG. 4, the movement back from the point Q to the point P takes place by lifting into the high lifting position and lowering again into the fully lowered position.

FIG. 6

Figure 6:
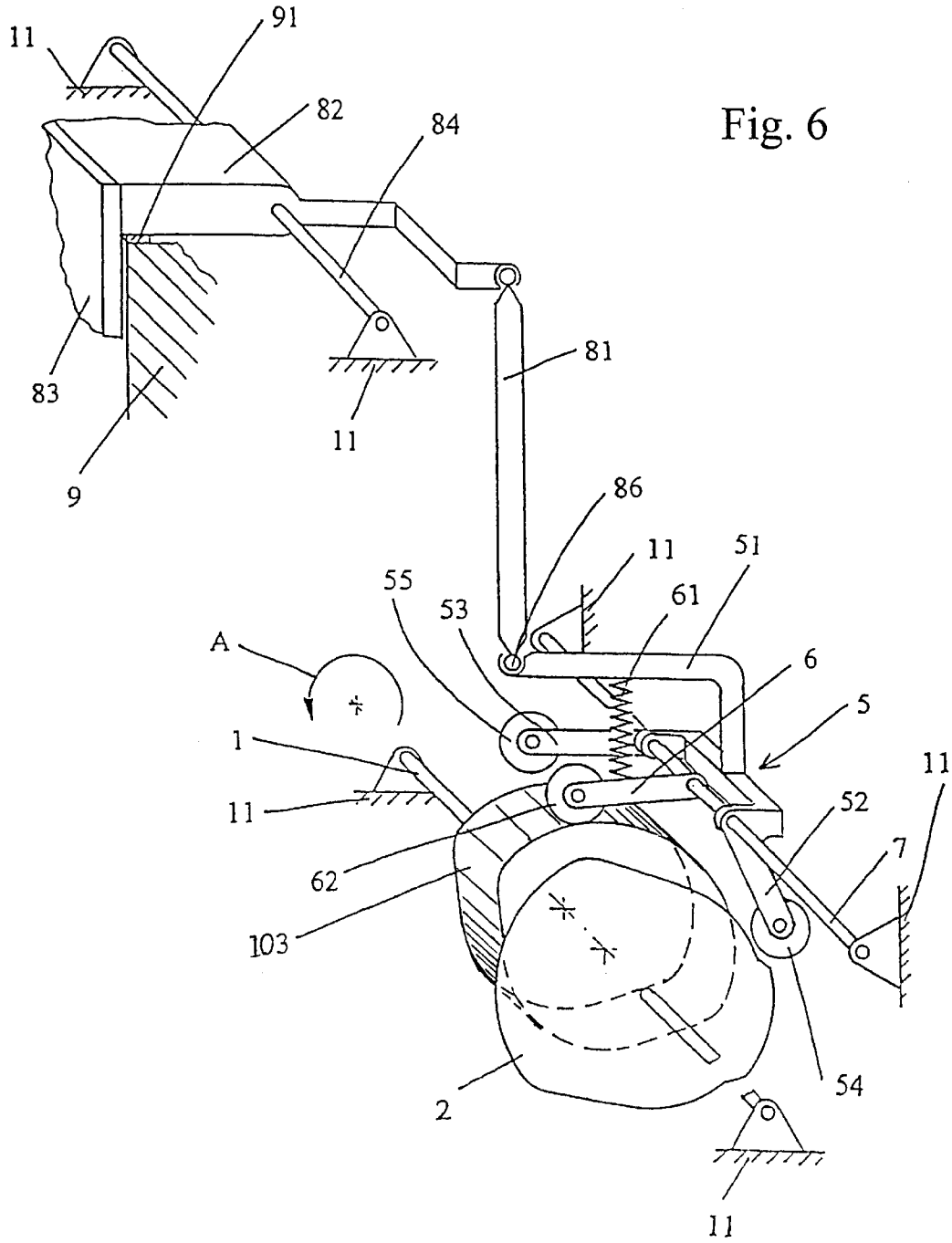
FIG. 6 shows a schematic representation of a second embodiment of an apparatus according to the invention.

FIG. 6 is a schematic representation of a second embodiment of the invention. The embodiment of FIG. 6 is identical to the embodiment of FIG. 1 except that the counter cam 3 and spring element cam 4 of the apparatus of FIG. 1 are merged, in the apparatus of FIG. 6, into a single spring element-counter cam 103. The operation of the embodiment of FIG. 6 is identical to the operation of the embodiment of FIG. 1 and therefore is not again described.

Further variations of the apparatuses according to the invention that are described above for producing a lifting and lowering movement for lifting and lowering transverse transporting tongs of a forming machine and of the paths of movement explained can be realized. Mention should also be expressly made here of the following:

The transmission of the lifting and lowering movement from the double lever 5 to the transverse transporting tongs can in practice take place in virtually any number of different ways. In particular, the double lever 5 could act directly on the tong case 82 and the transverse transporting tongs could be fastened to the tong case 82 directly and not via tong cartridges 83.

Different spindles, which need not be parallel, may be provided for the mounting of the double lever 5 and the spring element lever 6. The spindles could also be arranged, for example, at right angles to the transverse transporting tube 84.

The lifting and lowering movements may also be introduced for example onto a tong rocker, which bears the tong case with the transverse transporting drive.

Instead of the rotatable control shaft 1, a control shaft capable of rotary oscillation or a control slide capable of linear oscillation etc. may be provided, for example, as the movable cam carrier.

What is claimed is:

1. An apparatus for producing a lifting and lowering movement for lifting and lowering transverse transporting tongs of a forming machine, comprising:

a movable cam carrier on which a control cam and a counter cam are mounted;

a pivotably mounted double lever including a control roller arm and a control roller mounted on the control roller arm and rolling on the control cam, and a counter roller arm, fixedly mounted relative to the control roller, arm, and a counter roller, rotatably mounted on the counter roller arm and rolling on the counter cam, the control cam and the counter cam rotating the double lever in opposite directions of rotation through the control roller arm and counter roller arm, or respectively;

a movable spring element cam;

a spring element lever on which a spring element roller, is rotatably mounted, the spring element roller rolling on the spring element cam; and a spring element, arranged on the spring element lever and acting on the double lever to rotate the double lever in the same direction of rotation that the double lever is rotated by the counter roller.

2. The apparatus as claimed in claim 1, wherein the spring element cam is mounted on the movable cam carrier, and the double lever and the spring element lever are rotatably mounted on a common spindle.

3. The apparatus as claimed in claim 2, wherein the spring element cam and the counter cam have identical curved shapes and are a single cam.

4. The apparatus as claimed in claim 1, wherein pivoting of the double lever effected by the control cam lifts the transverse transporting tongs, and a pivoting of the double lever effected by one of the counter cam and the spring element cam lowers the transverse transporting tongs.

5. The apparatus as claimed in claim 1, wherein the control cam, the counter cam, and the spring element cam are shaped so that, in a fully lowered position of the transverse transporting tongs, the spring element roller bears against the spring element cam and the spring element exerts on the double lever a torque pressing the transverse transporting tongs downward, while the control roller is lifted off the control cam and the counter roller is lifted off the counter cam.

6. The apparatus as claimed in claim 1, wherein the control cam, the counter cam, and the spring element cam are shaped so that the transverse transporting tongs are lifted by the control cam against a torque exerted by the spring element on the double lever, to a low lifting position, and the counter roller is lifted off the counter cam.

7. The apparatus as claimed in claim 1, wherein the control cam, the counter cam and the spring element cam are shaped so that the transverse transporting tongs are lowered by the control cam, supported by the torque exerted by the spring element on the double lever, from a low lifting position into a fully lowered position, and the counter roller is lifted off the counter cam.

8. The apparatus as claimed in claim 1, wherein the control cam, the counter cam and the spring element cam are shaped so that the transverse transporting tongs are lifted by the control cam from a fully lowered position, against a torque exerted by the spring element on the double lever, into a middle lifting position, and the counter roller bears against the counter cam, and is lowered into the fully lowered position approximately three times as quickly in comparison with lifting, and the counter roller lifts off from the counter cam, assisted by the torque exerted by the spring element on the double lever.

9. The apparatus as claimed in claim 1, wherein the control cam, the counter cam, and the spring element cam are shaped so that the transverse transporting tongs are lifted by the control cam from a fully lowered position, against a torque exerted by the spring element on the double lever into a high lifting position, the counter roller bears against the counter cam, and is lowered into the fully lowered position, and the counter roller lifts off from the counter cam, assisted by the torque exerted by the spring element on the double lever.

10. The apparatus as claimed in claim 9, wherein the control cam, the counter cam and the spring element cam are shaped so that, during a movement cycle of the movable cam carrier, the transverse transporting tongs are lifted from a fully lowered position into a low or middle lifting position, and are lowered into the fully lowered position, are lifted from the fully lowered position into a high lifting position and, finally, are lowered from the high lifting position into the fully lowered position.

11. The apparatus as claimed in 1, wherein the movable cam carrier is a rotatable control shaft.

* * * * *

UNITED STATES PATENT AND TRADEMARK OFFICE

CERTIFICATE OF CORRECTION

PATENT NO. : 6,684,723 B1
DATED : February 3, 2004
INVENTOR(S) : Stefan Stöckle

It is certified that error appears in the above-identified patent and that said Letters Patent is hereby corrected as shown below:

Column 7,
Line 27, after "control roller" delete ","
Line 32, delete "or"
Line 37, after "a spring element" delete ","

Signed and Sealed this

Eighth Day of June, 2004

JON W. DUDAS
*Acting Director of the United States Patent and Trademark Office*